US005107927A

United States Patent [19]

Whiteley et al.

[11] Patent Number: 5,107,927

[45] Date of Patent: Apr. 28, 1992

[54] ORIENTING TOOL FOR SLANT/HORIZONTAL COMPLETIONS

[75] Inventors: Thomas G. Whiteley; John M. Jackson, both of Houston, Tex.

[73] Assignee: Otis Engineering Corporation, Carrollton, Tex.

[21] Appl. No.: 693,442

[22] Filed: Apr. 29, 1991

[51] Int. Cl.[5] ..... E21B 17/10; E21B 43/08; E21B 43/11

[52] U.S. Cl. ..... 166/50; 166/55.1; 166/227; 166/242; 175/4.51

[58] Field of Search ..... 166/241, 242, 205, 50, 166/55.1, 380, 227, 228, 233; 175/4.51

[56] References Cited

U.S. PATENT DOCUMENTS

| | | | |
|---|---|---|---|
| 1,697,482 | 1/1929 | Sperry | 166/228 X |
| 2,253,675 | 8/1941 | Arnold | 166/241 |
| 2,602,512 | 7/1952 | Baker | 166/241 |
| 2,804,926 | 9/1957 | Zublin | 166/50 |
| 2,847,075 | 8/1958 | Halbrook et al. | 166/241 |
| 3,240,274 | 3/1966 | Solum | 166/241 |
| 3,933,203 | 1/1976 | Evans | 166/241 |
| 3,967,680 | 7/1976 | Jeter | 166/250 |
| 4,071,101 | 1/1978 | Ford | 175/325 |
| 4,099,564 | 7/1978 | Hutchison | 166/241 |
| 4,269,278 | 5/1981 | Vann | 175/4.51 |
| 4,410,051 | 10/1983 | Daniel et al. | 175/4.51 |
| 4,448,248 | 5/1984 | Schwind | 166/241 |
| 4,553,595 | 11/1985 | Huang et al. | 166/278 |
| 4,658,896 | 4/1987 | Milam | 166/241 |
| 4,771,830 | 9/1988 | Peate | 166/241 |
| 4,919,208 | 4/1990 | Schneider | 166/241 X |
| 4,984,633 | 1/1991 | Langer et al. | 166/241 |
| 4,995,456 | 2/1991 | Cornette et al. | 166/50 X |
| 5,004,049 | 4/1991 | Arterbury | 166/233 X |

OTHER PUBLICATIONS

Advertisement—Vann Systems (Undated).
Advertisement—Gemoco (Undated).

*Primary Examiner*—Hoang C. Dang
*Attorney, Agent, or Firm*—Dennis T. Griggs

[57] ABSTRACT

A positioning tool is combined with a completion tool, for example a sand screen, for positioning the completion tool substantially within the lower half of a horizontal well casing member, and for automatically orienting the working face of the completion tool with respect to a predetermined sidewall portion of the well casing member. The orienting tool includes an annular roll collar which supports the completion tool off of the bottom of the horizontal well casing member, and a pair of radially projecting orienting vanes which limit rolling movement by engaging the upper bore of the well casing member.

19 Claims, 6 Drawing Sheets

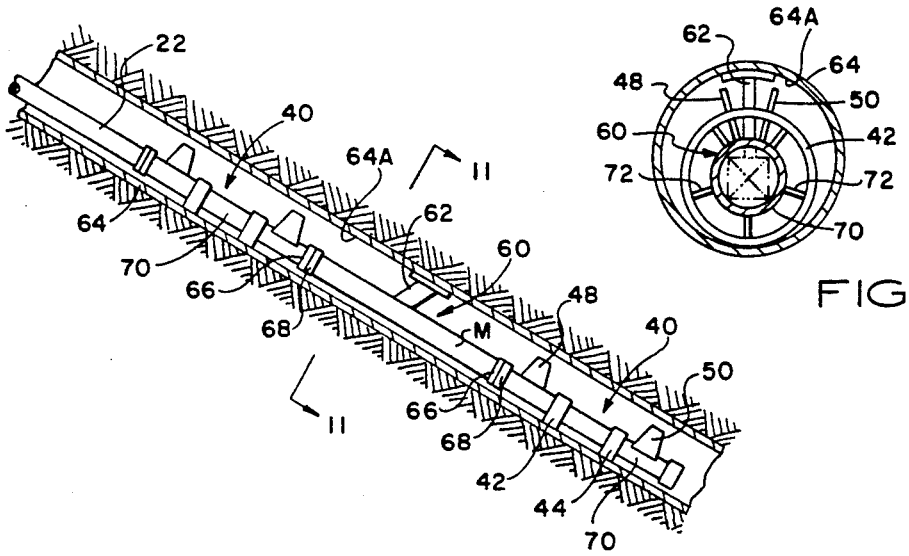
FIG. 11
FIG. 10
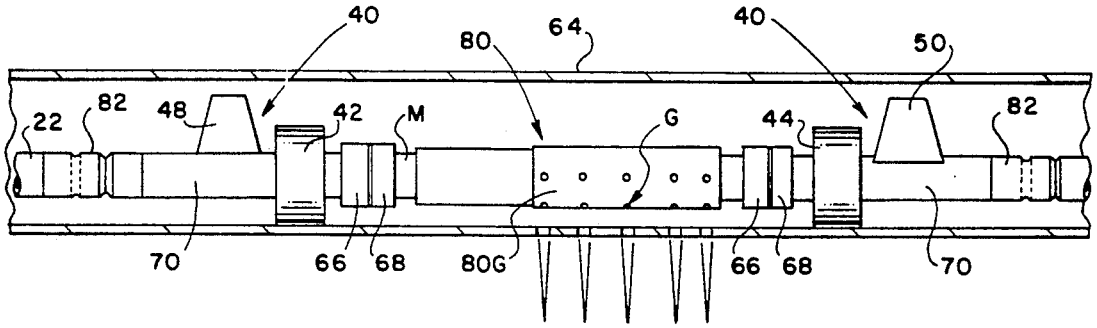
FIG. 12
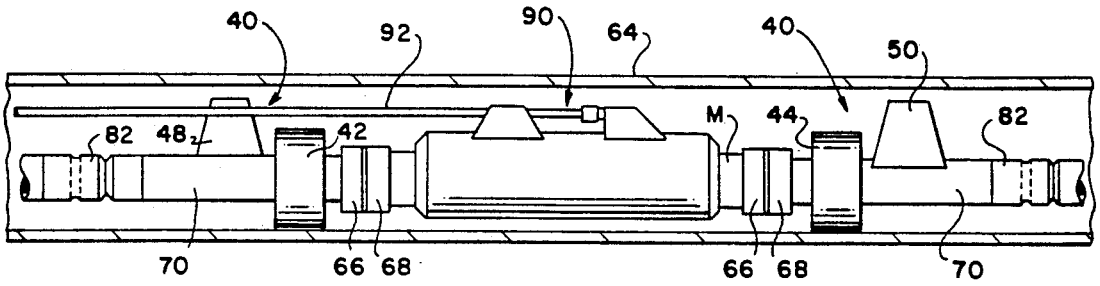
FIG. 13

ORIENTING TOOL FOR SLANT/HORIZONTAL COMPLETIONS

FIELD OF THE INVENTION

This invention relates generally to apparatus for completing downhole wells, and in particular to positioning tools for orienting completion equipment in slant and horizontal wells.

BACKGROUND OF THE INVENTION

In the course of completing an oil and/or gas well, it is common practice to run a string of casing into the well bore and then to run production tubing and completion tools inside the casing. It is often necessary to attach centralizers onto the production tubing or completion tool to prevent the tool from being abraded against the side of the casing and to prevent seizure of the tool as it traverses internal casing upsets or deviated casing sections. Most centralizers protect the completion tool by radial fins which are welded or molded onto the body of the centralizer sub or onto a blank tubing portion of the tool. The fins hold the tool substantially centered within the casing bore.

DESCRIPTION OF THE PRIOR ART

The principal function of conventional centralizer apparatus is to center the tubing string and completion tools along the longitudinal axis of the well casing as the production tubing is run through the bore. Some centralizers also perform other functions such as scraping debris (cement cake) from the casing sidewall. Other centralizer apparatus include turbulizer components which impart a swirling flow to completion fluids such as cement slurry or gravel pack slurry so that the slurry will flow uniformly around the production string.

Some completion tools include a well bore engaging component which must be positioned against the casing bore so that the tool can operate effectively. For example, a logging tool carries a transducer which is coupled in slidable surface engagement against the well casing bore. In vertical and near vertical wells, the positioning of such tools is accomplished by conventional centralizers. However, in slant, highly deviated and horizontal completions, the weight of the tool string may cause a radial displacement which will prevent coupling engagement between the engaging component and the well bore.

The positioning and orientation of tools such as sand screens, perforating guns, side pocket mandrels, circulation subs, and equipment such as safety valve landing nipples which carry external control lines is made more difficult by the weight of the tubing string which tends to cause the projecting portion of the tool to drag along the lower sidewall of the slant or horizontal well casing. Accordingly, orienting tools are needed which can position the radially projecting components of such tools in the upper casing annulus away from the bottom or lower side of the well casing. Orienting tools are also needed for positioning the working face of tools such as sand screens and perforating guns to face along the lower side surface of a well casing section which is to be protected by a gravel pack.

Centralizers and other positioning tools for supporting completion equipment in vertical, slant and horizontal wells are disclosed in the following U.S. Pat. Nos.:

| | | |
|---|---|---|
| 2,847,075 | R. L. Halbrook, et al. | "Tool and Guide Therefor" |
| 3,240,274 | J. R. Solum | "Flexible Turbulence Device for Well Pipe" |
| 3,933,203 | O. R. Evans | "Centralizer for Production String Including Support Means for Control Lines" |
| 3,967,680 | J. D. Jeter | "Method and Apparatus for Actuating A Downhole Device Carried By A Pipe String" |
| 4,071,101 | G. A. Ford | "Stabilizer for Single or Dual Tube Drilling" |
| 4,099,564 | S. O. Hutchinson | "Low Heat Conductive Frangible Centralizers" |
| 4,553,595 | W. S. Huang, et al. | "Method for Forming A Gravel Packed Horizontal Well" |
| 4,771,830 | W. R. Peate | "Apparatus for Positioning Well Tools in Deviated Well Bores" |
| 4,984,633 | F. H. Langer, et al. | "Nozzle Effect Protectors, Centralizers, and Stabilizers and Related Methods" |
| 4,995,456 | H. M. Cornette, et al. | "Gravel Pack Completions" |

SUMMARY OF THE INVENTION

Orientation of completion equipment in slant, deviated or horizontal wells is provided according to the present invention by a positioning tool having one or more annular roll collars mounted on a tubular mandrel for supporting a completion tool at a predetermined radial offset distance from the bore of the well casing member. Orientation of the tool is provided by radially projecting orientation blades which are longitudinally spaced and circumferentially offset with respect to each other. The annular roll collars permit the tool and tubing string to roll as it is advanced through the bore of the well casing member. The orienting blades limit the rolling movement of the tubing string by engaging the sides of the well casing member, thereby maintaining a predetermined tool orientation.

Because the orienting blades are mounted on the top side surface of the tool and are circumferentially offset with respect to the vertical centerline of the tool, the upper half of the tool will automatically be oriented to face upwardly along the top sidewall portion of the well casing member, and the lower half of the tool will be automatically oriented to face downwardly toward the lower sidewall portion of the well casing member. According to this arrangement, completion tools such as side pocket mandrels, perforating guns and safety valve landing nipples which have radially projecting components will be automatically oriented with the radially projecting components being positioned within the upper annulus between the tool and the well casing member in slant and horizontal wells. Moreover, other completion tools such as sand screens and perforating guns will be automatically oriented with their work surfaces facing in the desired direction within the annulus as is predetermined by the position of the orientation blades on the tool.

Other features and advantages of the present invention will be appreciated by those skilled in the art upon reading the detailed description which follows with reference to the attached drawings.

BRIEF DESCRIPTION OF THE DRAWINGS

FIG. 10 is a simplified sectional view showing the positioning sub of FIG. 8 in combination with a well logging tool in a slant well bore;

FIG. 11 is a sectional view thereof taken along the line 11—11 of FIG. 10;

FIG. 12 is a simplified sectional view which illustrates the positioning apparatus of the present invention in combination with a perforating gun;

FIG. 13 is a simplified sectional view which illustrates the positioning apparatus of the present invention in combination with a safety valve landing nipple;

DETAILED DESCRIPTION OF THE PREFERRED EMBODIMENT

Figure 1:
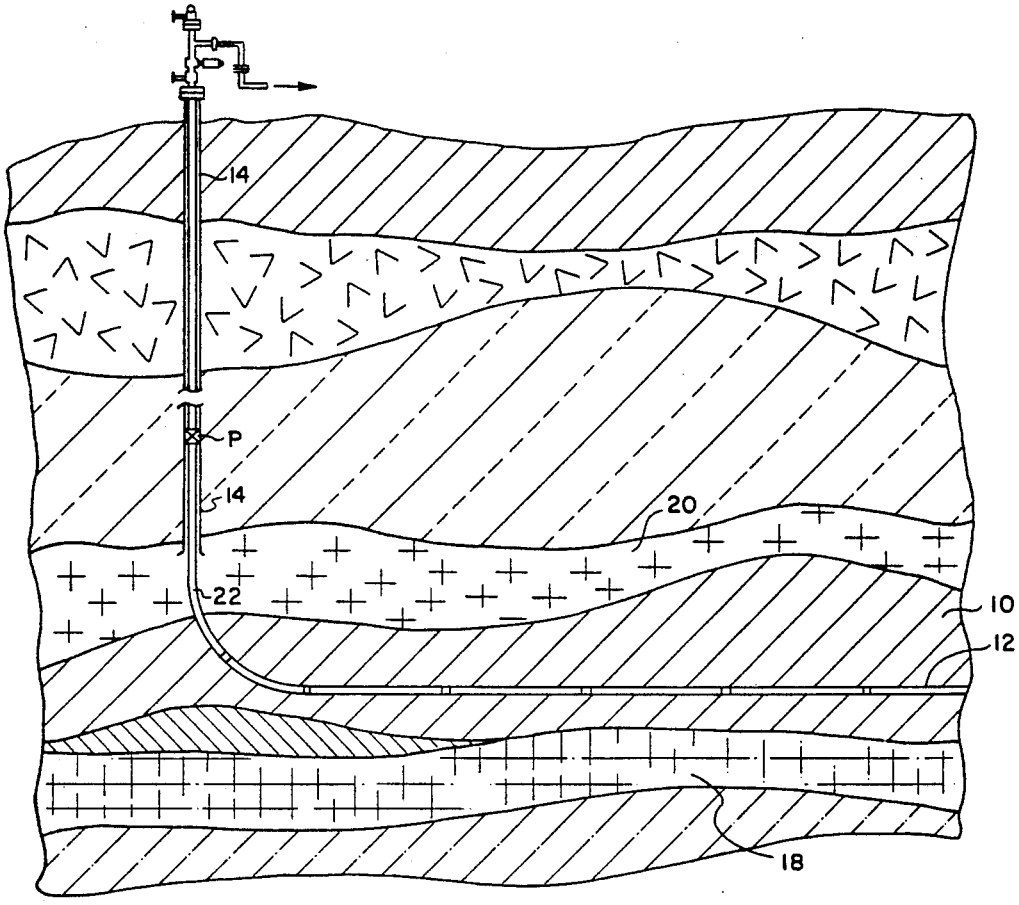
FIG. 1 is a simplified sectional view which illustrates the installation of a sand screen and the orienting tool of the present invention in a horizontal well completion.

In the description which follows, like parts are indicated throughout the specification and drawings with the same reference numerals, respectively. The drawings are not necessarily to scale and the proportions of certain parts have been exaggerated to better illustrate details of the invention.

The orienting tool of the present invention is specifically adapted for use in slanted and horizontal well completions. Horizontal well completions are characterized by increased production rates, improved drainage of heterogenous reservoirs, and reduced water and gas coning rates. However, horizontal wells present unique formation and sand control problems relating to orientation of completion equipment which cannot be completely overcome by conventional positioning tools.

Conventional approaches overcoming formation/-sand control problems are use of a slotted well bore liner, a wire wrapped or prepacked screen, and a gravel pack to stabilize the surrounding formation. A slotted liner may prevent a weakly consolidated sandstone from completely filling the well bore. However, even the best screen design will allow some sand to flow into the well bore until a stable gravel pack is obtained. Sand that flows through the slotted liner will fall to the low side of the horizontal hole and accumulate about the screen, as producing fluids bypass it. The effect on fluid flow of sand which penetrates the slotted liner may not be realized until the screen is almost completely filled with sand and production is substantially reduced.

The slotted liner will help prevent total collapse of a well bore, but is subject to plugging. A well screen will prevent sand from filling the production bore, but it also subject to plugging by fines and debris during installation and when the well is initially put on production. A well screen of the prepacked type typically includes 20/40 U.S. mesh gravel consolidated with plastic. Invasion of even a small amount of drilling mud and formation fines into the pores between the gravel may plug the prepacked screen.

Well bore collapse, screen plugging and sand bridging can be substantially reduced by properly placing a gravel pack in the annulus between the screen and the liner, and in the formation surrounding the liner. Gravel packing along the horizontal liner is difficult because the surrounding formation tends to collapse before the gravel pack is completely packed in place. Moreover, the gravel will tend to precipitate out of the slurry and fall along the sides of the liner by gravity flow before it is completely packed, thereby leaving the top of the liner exposed to sand accumulation, plugging and bridging. Moreover, fluid lost to the formation over the long, permeable interval surrounding the horizontal well bore may cause formation damage and reduce the velocity of the circulation fluid below the minimum required to transport the gravel. Consequently, there is continuing interest in providing improved gravel packing apparatus for successfully transporting and packing gravel over the entire screen length in a long, horizontal well bore.

Gravel which is not tightly packed will settle and thereby produce a void space in the annulus above the screen. Such spaces that are not filled with gravel are sooner or later filled up with accumulated sand, forming sand plugs or bridges. Fine formation sand still finds its way through these bridges into the production flow path, causing erosion of production equipment. In some situations, the sand fines may include plugging materials which are carbonaceous, siliceous or organic solids which can completely plug the screen mandrel flow passages and terminate production shortly after completion. In deep wells, when the screen becomes plugged and the pressure in the production tubing is reduced, the formation pressure can collapse the screen and production tubing. Moreover, when a substantial amount of sand has been lost from the surrounding formation, the formation may collapse with resultant damage to the slotted liner and consequent reduction or termination of production. Improved completion equipment for producing a gravel pack, containing no unfilled spaces, is thus desirable for more efficient sand screen operation.

When the gravel pack is properly positioned in the horizontal well bore annulus surrounding the screen, and in the formation annulus surrounding the slotted liner, the gravel supports the liner sidewall and the surrounding formation, prevents caving of unconsolidated material against the liner, and also restrains formation particulate material from flowing into the horizontal bore hole with the produced fluids. Accordingly, there is considerable interest in providing improved methods and apparatus for properly positioning the gravel pack in a horizontal well completion.

A conventional technique for placing a gravel pack in a horizontal well is to pump a slurry containing the gravel down the tubing string which supports the liner. The slurry is pumped into the annulus between the screen and the liner, and is squeezed through the liner perforations into the formation surrounding the liner. The gravel in the slurry has a tendency to settle due to gravity and form a permeable boot in the formation below the lower half of the liner, but leaving a void space in the formation above the upper half of the liner, which eventually will be filled and covered by a sand bridge. Moreover, when pumped through the annulus between the screen and the horizontal liner, the gravel slurry has a tendency to flow unevenly along the lower inside surface of the liner, which will result in a concentration of gravel in the lower half of the annulus surrounding the screen within the slotted liner. As the gravel settles, void spaces will be left in the annulus along the top half of the screen in which sand fines will accumulate. Consequently, heavy production of sand fines can be expected in formation fluid inducted through the upper unprotected half of the screen along the upper half of the liner annulus, and the sand fines will be substantially excluded by the gravel pack in the lower half of the well bore annulus.

Figure 2:
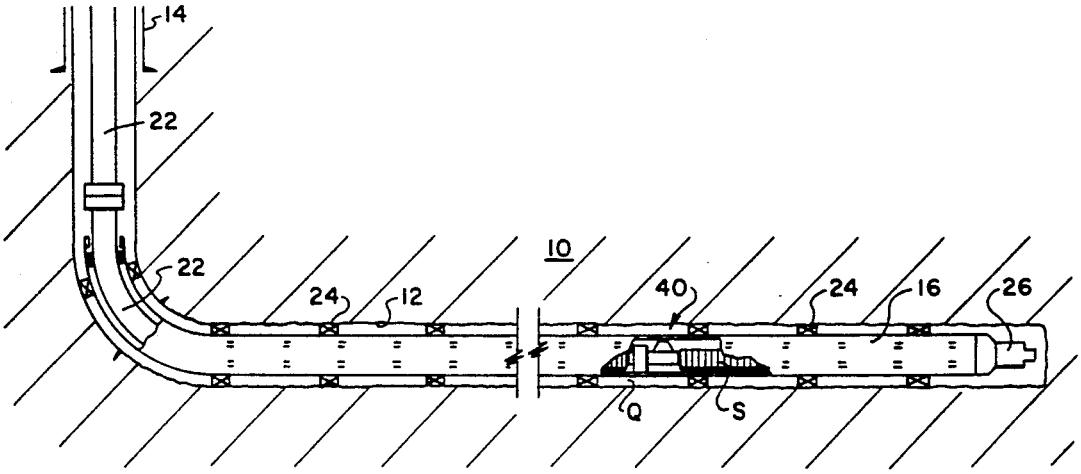
FIG. 2 is a simplified sectional view which illustrates well bore details of the horizontal completion shown in FIG. 1.
Figure 3:
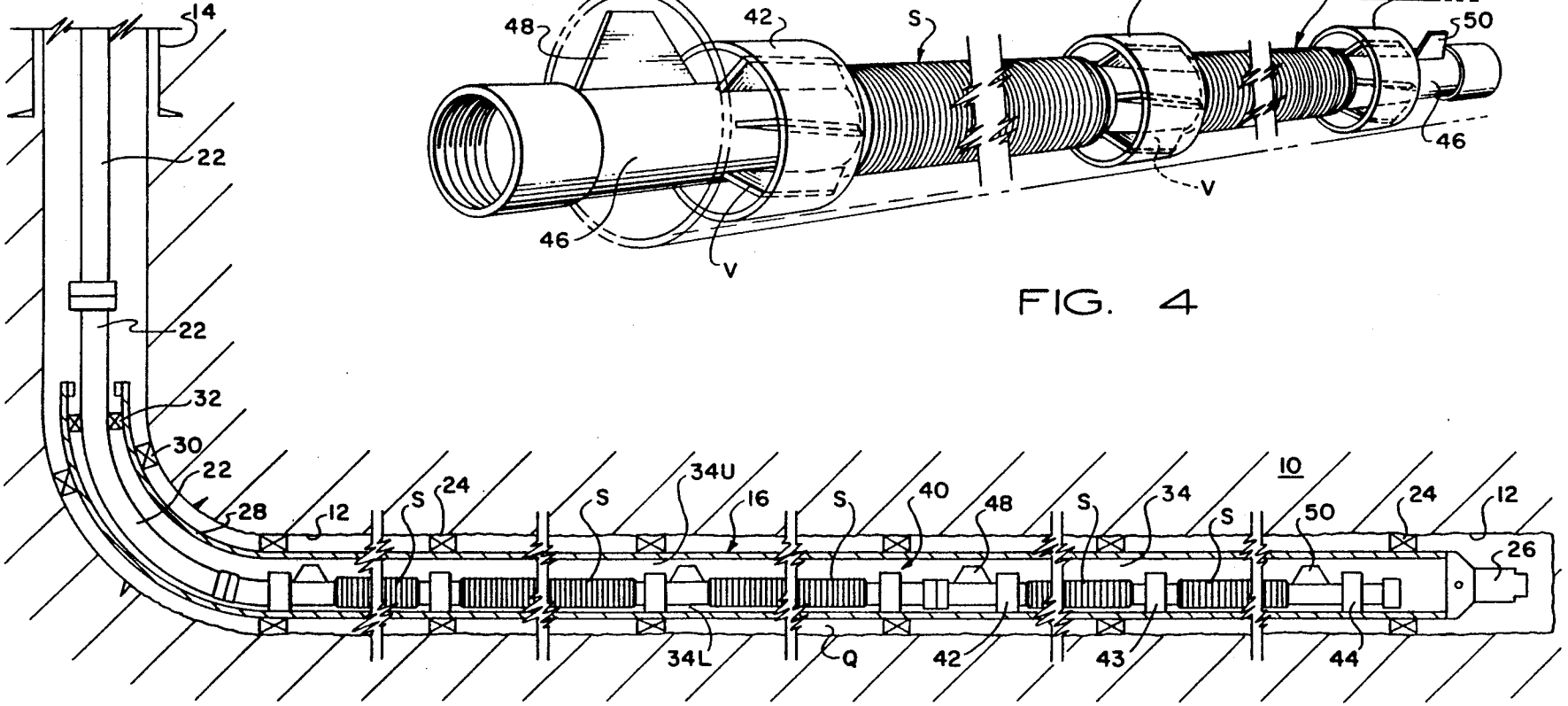
FIG. 3 is an enlarged view of the horizontal completion shown in FIG. 1, with the slotted casing liner being shown in section, thereby revealing the sand screen and orienting tool assembly of the present invention.

A typical horizontal completion which utilizes a slotted well liner, a prepacked screen S and a gravel pack to exclude sand fines and stabilize the surrounding formation is shown in FIGS. 1, 2 and 3. A hydrocarbon formation 10 is intersected by a horizontal well bore 12. A string of tubular well casing 14 extends. Vertically through multiple layers of overburden, with the producing formation 10 being penetrated by the horizontal well bore 12 in which a casing member such as a slotted liner 16 or perforated casing is cemented in place. The hydrocarbon producing formation is confined vertically between an underburden layer 18 and an overburden layer 16, typically of an impervious siltstone or other barren rock. For illustrative purposes, the hydrocarbon producing formation is typically at a depth of 7,500 feet with a reservoir pressure of 2,000 psi and a reservoir temperature of 130 degrees F. The overburden layer 20 and the underburden layer 18 are impervious to the flow of gas.

The typical horizontal production well is completed by multiple tubular screens S which are supported by a lower tubing string 22 suspended from a production packer P. The tubing string 22 is referred to as the "work" string during installation, and becomes the "production" string after completion. The serially connected sand screens S are inserted into the horizontal well bore which penetrates horizontally through the narrow producing formation. The horizontally extending hydrocarbon formation 10 varies from about 20 feet in depth to about 500 feet in depth, and extends through a horizontal range, typically from about 500 to 5,000 feet. The horizontal well bore is reinforced by a perforated casing or by the slotted liner 16 which is supported within the horizontal bore by inflatable casing annulus packers 24, which isolate fracture zones.

The diameter of the slotted liner 16 is typically 4½ inches, and the production tubing diameter is typically 2⅜ inches. The slotted liner is terminated by an inflatable bridge plug 26 or equivalent means. The slotted liner 16 is positioned within the well bore and is coupled to the tubing string 22 by a cemented gas isolation liner 28, by a cement filled formation packer 30 and an annular gas plug 32. After the screens S and tubing string 22 have been set inside the horizontal liner 16, the annulus 34 of the horizontal liner and the formation surrounding the horizontal liner is gravel packed to stabilize the surrounding formation and to exclude sand fines from entering the screen S.

In recognition of the gravity flow effect in which the gravel will be distributed unevenly and concentrated along the lower half annulus 34L in which the screen assembly or other sand control device is supported and in the lower interface zone Q between the formation 1 and the liner, it is desirable to position the screens S, at an appropriate standoff distance from the bore of the liner to permit free flow of formation fluid through the lower half of the screen. Moreover, recognizing that the gravel will tend to settle about the screen within the lower half 34L of the casing liner annulus, which may produce a void space in the annulus 34U above the screen which subsequently will be filled and covered by a sand bridge, it is desirable to constrain the induction of formation fluid through the lower half portion B of the screen S. In constraining the induction of formation fluid through the lower half B of the screen which is protected by a gravel pack, it is also desirable to block the flow of formation fluid through the upper top half T of the screen to thereby avoid the production of sand from the unprotected upper annulus 34U between the screen and liner. Otherwise, sand fines inducted through an unprotected upper screen section would eventually plug the entire screen as well as causing erosion damage to production equipment.

According to one aspect of the invention, an improved orienting tool 40 (FIG. 4) is provided for positioning the sand screens S substantially within the lower half of the horizontal casing liner 16. For this purpose, the orienting tool 40 is combined with two sand screen sections S and includes annular roll collars 42, 43 and 44 mounted on a tubular support mandrel 46 in radially spaced, standoff relation with respect to the external surface of the screen. The roll collars support the screen surfaces at a predetermined radial offset distance from the lower bore of the liner, and provide an induction annulus 34L between the screen S and the horizontal liner bore 16A. The flow of formation fluid is constrained to enter the lower half of the screen S by forming flow inlet apertures A (FIG. 5, FIG. 6) only through the bottom lower half B of the screen mandrel sidewall M, with the top half T of the screen mandrel sidewall being blank (unperforated).

Figure 6:
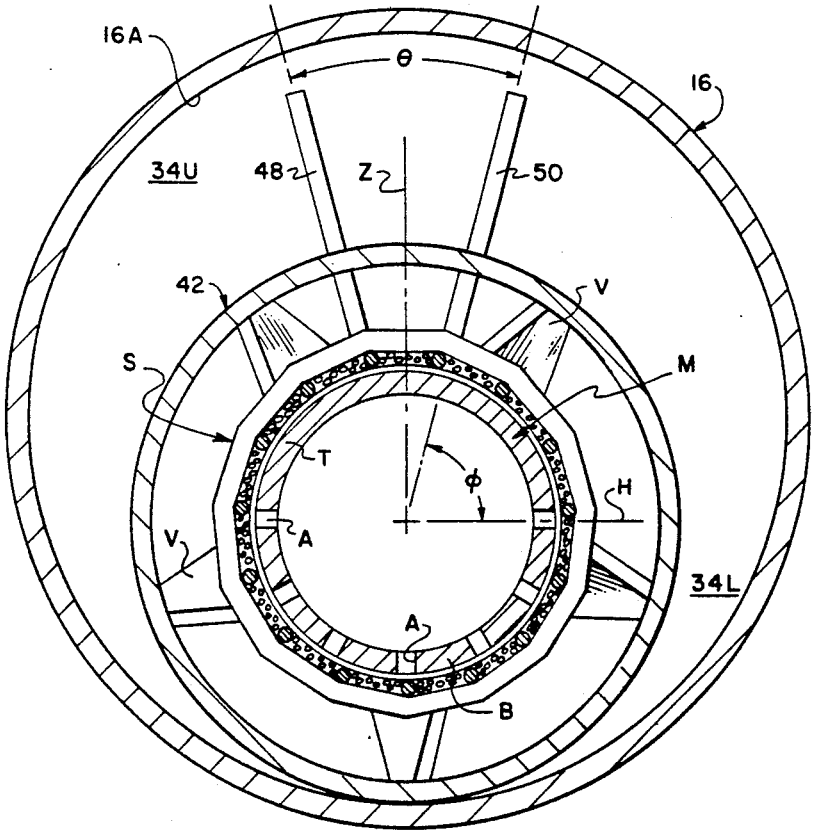
FIG. 6 is a sectional view thereof taken along the line 6—6 of FIG. 5.

Orientation of the production tubing string and sand screens is provided by a plurality of orienting blades 48, 50 which are longitudinally spaced with respect to each other along the sand screen tubing string. Referring to FIG. 6, the orienting blades 48, 50 project radially from the sand screen mandrel, and are circumferentially offset with respect to each other by an acute angle $\theta$. The orienting blades 48, 50 are mounted on the top unperforated half of the sand screen mandrel, and project at a predetermined acute angle $\Phi$ with respect to the horizontal centerline H of the sand screen S. Preferably, the orienting blades 48, 50 are symmetrically disposed with respect to the vertical centerline Z of the sand screen S.

According to this arrangement, as the tubing string 22 is run into the horizontal liner 16, the annular standoff roll collars 42, 44 permit the sand screen S and tubing string 22 to roll as it is advanced through the bore of the horizontal liner. The orienting blades 48, 50 limit the rolling movement of the horizontal tubing string by engaging the interior sidewall bore 16A of the liner.

Because the orienting blades 48, 50 are diametrically opposite the perforated lower half section B of the screen, the perforations A in the lower half of the screen will be automatically oriented to face downwardly toward the low sidewall portion of the liner. The weight of the production tubing string 22 will hold the annular roll collars 42, 44 against the bottom of the liner within the gravel pack concentration zone, and the downwardly facing orientation of each perforated screen section B is maintained by engagement of the orienting blades against the upper liner bore 16A as the sand screen attempts to roll or rotate out of the downwardly facing orientation.

According to this arrangement, formation fluid is constrained to flow through the perforated lower half portion B of the screen S which is protected by a gravel pack. At the same time, the flow of formation fluid is blocked through the unprotected upper half T of the screen, since the upper half of the screen mandrel is unperforated. Consequently, sand fines from the accumulation in the upper liner annulus are blocked by the unperforated upper half section of the packer mandrel, and are excluded by the gravel pack in the lower annulus concentration zone which surrounds the perforated screen mandrel.

According to another aspect of the present invention, the annular roll collars 42, 44 are attached to the screen mandrel by flow vanes V which project radially and transversely with respect to the sand screen so that a turbulent flow pattern is inducted in the gravel pack slurry as it is pumped through the liner or casing annulus 34. The gravel slurry, which has a tendency to flow unevenly along the lower inside surface of the liner, will be subjected to a swirling, turbulent motion as it flows between the vanes. According to this arrangement, gravity settling effects such as duning, uneven distribution and/or voids in the gravel pack are overcome as the slurry is pumped throughthe the bore of the horizontal casing or liner, with the turbulence and swirling motion imparted by the vanes causing the gravel to be substantially uniformly distributed within the slurry and throughout the annulus as it is pumped through the horizontal liner.

Figure 4:
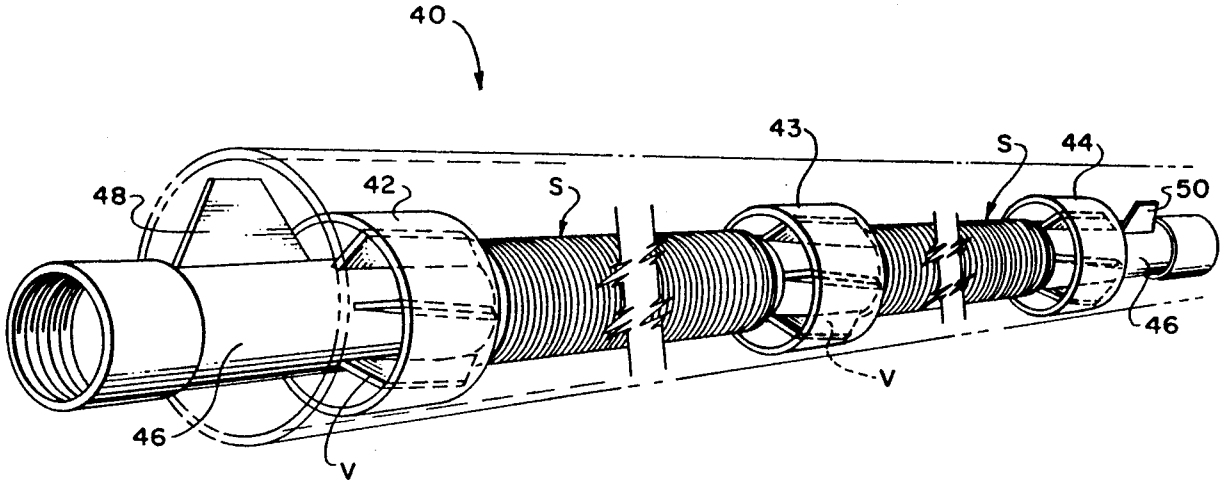
FIG. 4 is a perspective view of a dual section sand screen and orienting tool assembly.
Figure 5:
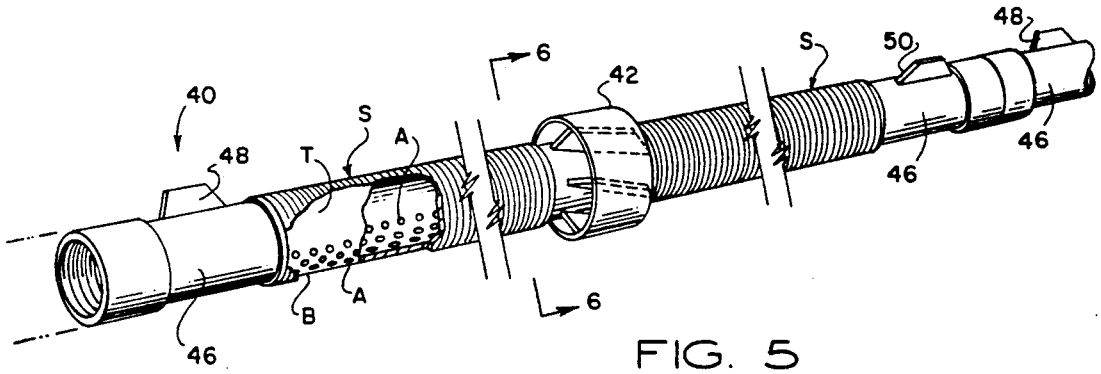
FIG. 5 is a perspective view, partially broken away, a dual section sand screen and orienting tool assembly constructed according to an alternative embodiment of the present invention.

The orienting tool 40 is integrated within a dual section sand screen assembly as shown in FIG. 4 and FIG. 5. That is, in FIG. 4, the orienting blades 48, 50 and roll collars 42, 43 and 44 are attached directly to the tubular support mandrel 46 of each sand screen S. In FIG. 5, both orienting blades 48, 50 are attached directly to the perforated section screen mandrel M, with a single roll collar 42 being attached to the tubing support mandrel 46 between adjacent screen sections. The roll collars and sand screens need not be attached to the same mandrel, and may be mounted onto adjoining mandrels when two or more tool sections are connected in series.

As shown in FIG. 6, the screen S has a wire wound screen which is prepacked with gravel, thereby providing a particulate-restricting member, which is preferably constructed according to U.S. Pat. No. 5,004,049, which is incorporated herein by reference for all purposes.

Figure 7:
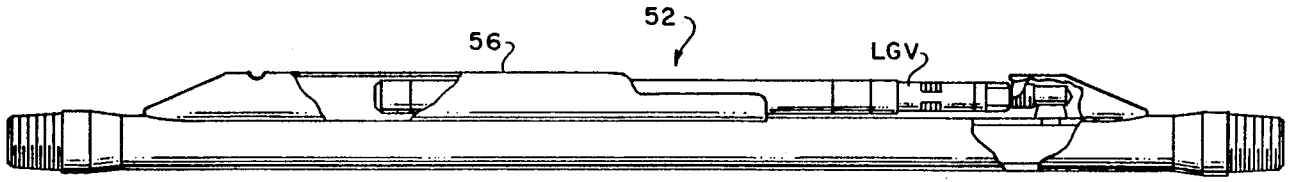
FIG. 7 is a side elevational view, partially broken away, of a side pocket mandrel and lift gas valve which is utilized in the lift gas completion shown in FIG. 9.
Figure 8:
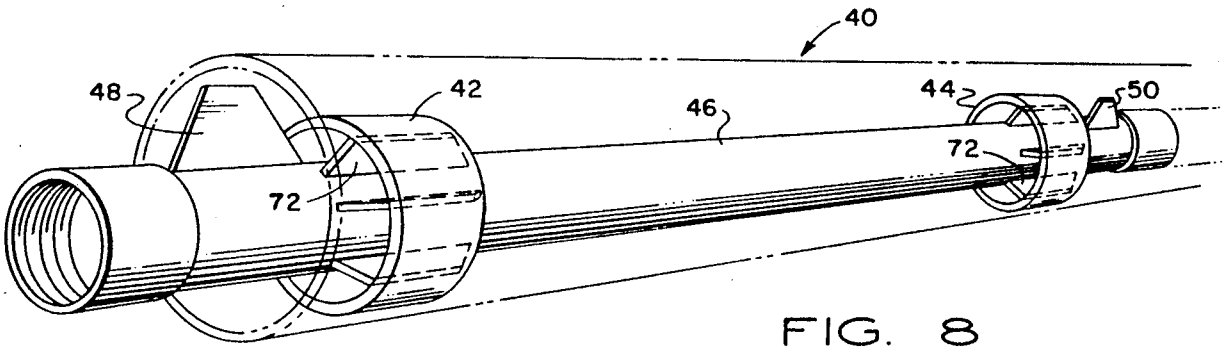
FIG. 8 is a perspective view of a positioning sub constructed according to an alternative embodiment of the present invention.
Figure 9:
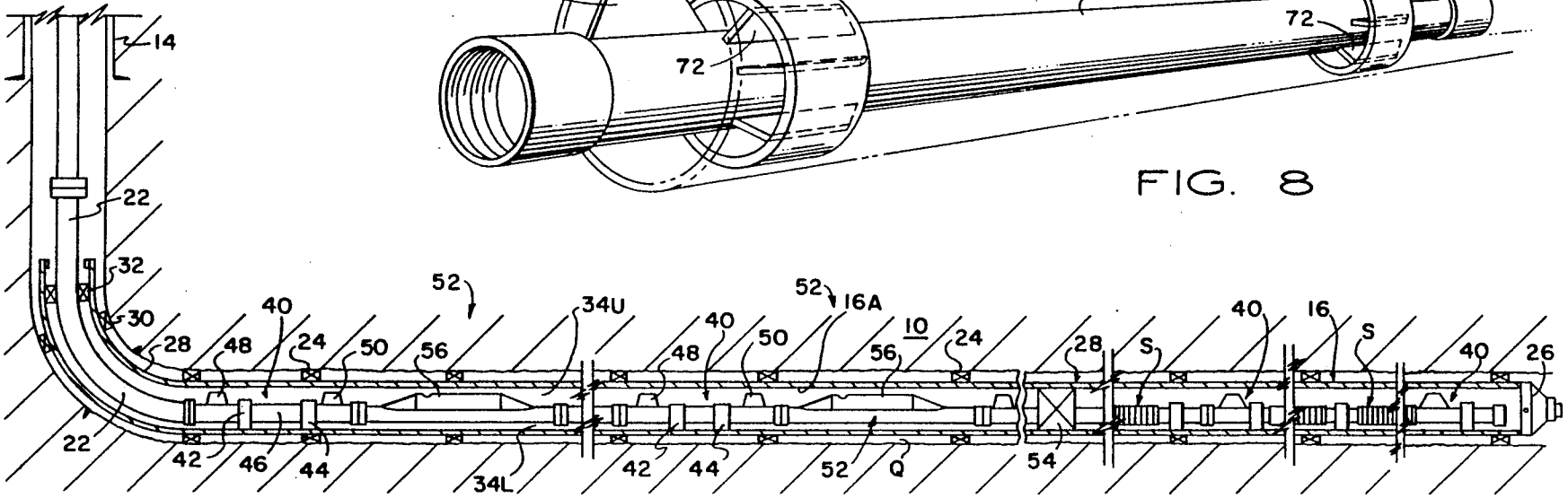
FIG. 9 is a simplified sectional view which illustrates installation of a sand screen tubing assembly, a lift gas valve assembly and the positioning sub in a horizontal well completion.

As shown in FIG. 7, FIG. 8 and FIG. 9, a plurality of lift gas injection tools 52 are connected in series with the sand screens S for enhancing production. The annulus of the gas isolation liner 28 is sealed by a packer 54 and lift gas is injected into the production bore through the lift gas valves LGV which are mounted within a side pocket mandrel 56. It is essential that the side pocket mandrel 56 be maintained in the upright orientation in the upper casing annulus 34U to avoid scraping damage against the well casing bore. This is provided according to the present invention by one or more orienting tools 40 which are connected in series between adjacent lift gas injection tools 52.

Referring now to FIG. 10, a logging tool 60 having a radially projecting transducer 62 is supported within the bore 64A of a well casing 64 which is cemented within the bore of a slant well. The logging tool 60 is supported on opposite ends by separate orienting tools 40. The orienting tools 40 maintain engagement of the transducer 62 against the upper inside diameter bore 64A of the well casing 64. In this exemplary embodiment, the orienting tool 40 is not integrated with the logging tools 40, but is instead mechanically coupled by pin and box connectors 66, 68. The roll collars 42 are supported on tubular sub 70 by standoff arms 72.

Referring now to FIG. 12, another exemplary embodiment is illustrated in which a perforating gun 80 is supported within a horizontal casing 64 for perforating the lower half section of the casing. In this arrangement, the perforating gun 80 has a working face 80G for directing shaped charges for piercing the lower sidewall half section of the casing 64. In this arrangement, the orienting tool 40 is separated from the perforating gun tool 80, with the opposite ends of the perforating gun being supported by the roll collars 42, 44. The perforating guns G are oriented in a downwardly facing direction by the orienting blades 48, 50. The perforating gun 80 and orienting tool assembly 40 is coupled to the work string 22 by swivel subs 82 which permit flexure and articulation of the tubing string as it is run through deviated bore sections.

Another exemplary embodiment is shown in FIG. 13, in which a safety valve landing nipple 90 is supported on opposite ends by the orienting tool assembly 40 of the present invention. In this embodiment, the safety valve landing nipple 90 has a hydraulic control line 92 which connects the safety valve to a source of pressurized hydraulic fluid at the surface. In running the safety valve landing nipple 90 through slant and deviated bores, it is essential to maintain the hydraulic control line 92 in the upper annulus to avoid separating or pinching the line. This function is provided by the orienting tool assembly 40 in combination with the swivel subs 74 which maintain the control line 92 in the upright, upper annulus orientation as shown in FIG. 13.

Figure 14:
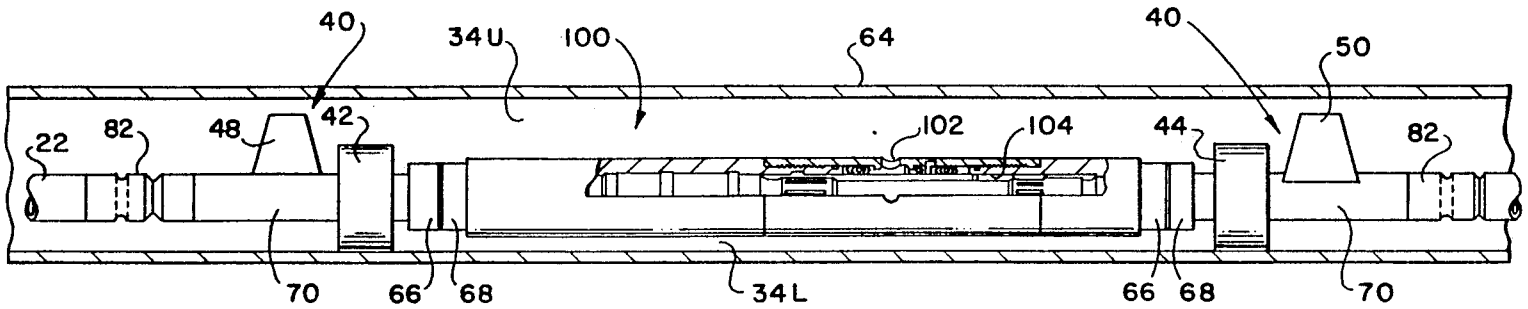
FIG. 14 is a simplified sectional view which illustrates the positioning apparatus of the present invention in combination with a circulation sub.

Yet another exemplary embodiment is shown in FIG. 14, in which a circulation/production access tool 100 is supported on opposite ends by the orienting tool assembly 40 of the present invention. In this embodiment, the circulation/production access tool 100 includes circulation ports 102 which can be opened and closed by the sidewall of a tubular, slidable sleeve 104. Such a circulation/production access tool is offered by Otis Engineering Corporation under the registered trademark SLIDING SIDE DOOR®, and as described in Otis Engineering Corporation Brochure OEC 5441.

In this exemplary embodiment, the circulation ports 102 are formed only on the top semicylindrical sidewall section of the circulation/production access tool 100, and the lower semicylindrical half section is blank. Since the circulation ports 102 are formed only on the upper semicylindrical half section, it is desirable to maintain the upper semicylindrical section and access ports 102 in the upper annulus 34U to provide communication between the tubing string bore and the well casing annulus, for example when circulating kill fluid or washing above a packer. The orienting tool 40 maintains the upwardly facing orientation of the circulation ports 102, thereby permitting free flow between the upper annulus 34U and the tubing string bore. Constraining circulation through ports 102 which are located only in the upper casing annulus rather than through the lower sidewall bore annulus near the bottom or lower side of the well casing avoids the risk that the circulation ports will become plugged by trapped debris or blocked by close proximity to the well casing bore.

Figure 15:
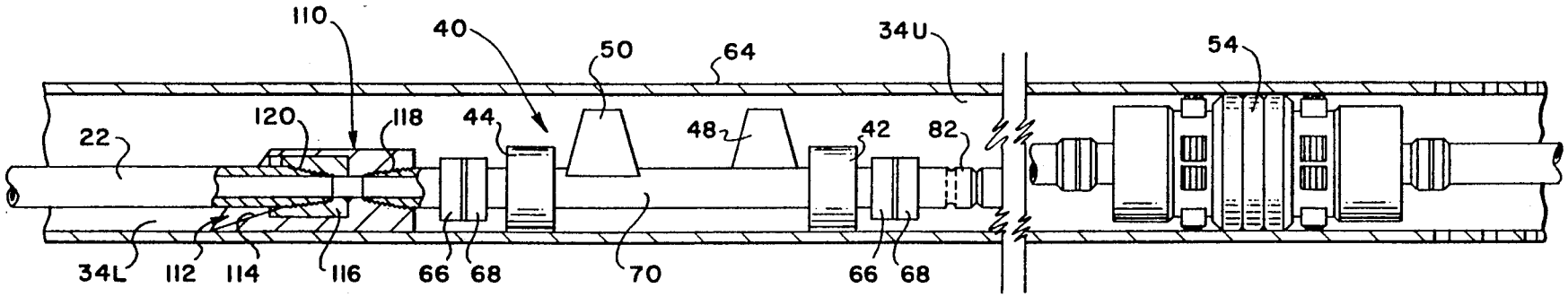
FIG. 15 is a simplified sectional view which illustrates the positioning apparatus of the present invention in combination with a scoop head landing assembly.

Still another exemplary embodiment is shown in FIG. 15 in which a scoop head landing assembly 110 is supported on one end by the orienting tool assembly 40 of the present invention. In this arrangement, the orienting tool assembly 40 is interposed between the packer 54 and the production tubing string 22. The orienting tool 40 is coupled to the packer 54 by a swivel sub 82. The scoop head landing assembly 110, the orienting tool 40 and swivel sub 82 are made up with the packer 54 and are run into the well on the work string 22.

It is desirable in some instances to release the tubing string 22 from the packer 54 and retract the tubing string from the well to permit some other operation to be conducted. Thereafter, it is desirable to run the tubing string 22 into the well and reestablish flow communication with the packer. Since the tubing string 22 will tend to ride on the bottom sidewall surface of the well casing bore, the threaded end portion of the tubing string 22 must be guided and directed as it is stabbed into the threaded coupling box of the packer.

Such guidance is provided in this horizontal completion by the scoop head landing assembly 110 which includes a threaded box coupling 118, a lead-in pocket 112 and a sloping sidewall 114 which transitions smoothly from a point near the bottom bore of the casing sidewall radially inwardly to a point where the threaded coupling box begins. It should be understood that the scoop head landing tool 110 shown in FIG. 15 is simplified, and that the tubing string 22 is coupled to the landing scoop by a releasable latch assembly 16 in which a threaded coupling box 120 is formed.

For best performance, the scoop pocket 12 should be maintained in the lower casing annulus 34L so that the threaded pin connector portion of the tubing string 22 will engage the lead-in surface 114 and be guided into alignment with the threaded box connector 120 of the latch 116. The landing scoop assembly 110 is initially made up and connected to the orienting tool 40 by the threaded coupling box connector 118 with the scoop pocket 112 and lead-in surface 114 positioned below the horizontal centerline of the orienting tool assembly. Thereafter, the scoop pocket 112 and lead-in guide surface 114 are maintained within the lower annulus of the well casing as the packer is run through the bore of the horizontal well casing 64.

The invention has been described with reference to certain exemplary embodiments, and in connection with slant as well as horizontal well completions. Various modifications of the disclosed embodiments as well as alternative well completion applications of the invention will be suggested to persons skilled in the art by the foregoing specification and illustrations. It is therefore contemplated that the appended claims will cover any such modifications or embodiments that fall within the true scope of the invention.

What is claimed is:

1. Apparatus for orienting completion equipment in deviated and horizontal wells comprising, in combination:

a tubular mandrel;

annular coil collar means attached to said mandrel in radially spaced, standoff relation therewith; and, first and second tool-orienting blades attached to said mandrel, said tool-orienting blades projecting radially with respect to said mandrel, and said tool-orienting blades being longitudinally spaced and circumferentially offset with respect to each other, the radial projection of each tool-orienting blade relative to the tubular mandrel being greater than the radial standoff of the annular roll collar relative to the tubular mandrel.

2. Orienting apparatus as defined in claim 1, wherein said tubular mandrel has a horizontal centerline, wherein the first tool-orienting blade is angularly displaced with respect to the horizontal centerline by an acute angle, and wherein the second tool-orienting blade is angularly offset with respect to the first tool-orienting blade by an acute angle.

3. Apparatus for orienting completion equipment in deviated and horizontal wells comprising, in combination:

a tubular mandrel;

an annular roll collar attached to said mandrel in radially spaced, standoff relation therewith;

first and second tool-orienting blades attached to said mandrel, said tool-orienting blades projecting radially with respect to said mandrel, and said tool-orienting blades being longitudinally spaced and circumferentially offset with respect to each other; and, wherein the annular roll collar has a radial standoff spacing relative to the tubular mandrel which is less than the inside radius of a well casing in which the orienting apparatus is to be inserted, and wherein the tool-orienting blades have a radial projection which is less than the radius of the well casing, and which is greater than the radial projection of the annular roll collar.

4. A sand screen assembly for separating particulate material from formation fluid comprising, in combination:

a sand screen having a fluid-porous particulaterestricting section;

an annular roll collar attached to said sand screen in radially spaced relation with respect to said particulaterestricting member; and, an orienting blade attached to said sand screen, said orienting blade projecting radially outwardly with respect to said annular roll collar.

5. A sand screen assembly for separating particulate material from formation fluid comprising, in combination:

a mandrel having a tubular sidewall defining a flow passage for conveying formation fluid, said tubular sidewall having a first semicylindrical sidewall section and a second semicylindrical sidewall section, said first semicylindrical sidewall section being unperforated, and said second semicylindrical tubular sidewall section having perforations for admitting formation fluid into the flow passage;

a fluid-porous particulate-restricting member mounted on said mandrel;

an annular roll collar attached to said mandrel in radially spaced relation with respect to said particulaterestricting member; and, an orienting blade attached to said mandrel, said orienting blade projecting radially with respect to said fluid-porous particulate-restricting member.

6. A sand screen assembly for separating particulate material from formation fluids comprising, in combination:

a plurality of sand screens each having a perforated mandrel and a fluid-porous particulate-restricting section mounted on the perforated mandrel, said perforated mandrels being coupled together in tandem relation, thereby defining a longitudinal production flow passage;

a plurality of annular roll collars attached to said sand screen assembly, said annular roll collars being longitudinally spaced with respect to each other, and each having a cylindrical sidewall disposed in radially spaced relation with respect to the fluid-porous, particulate-restricting members; and, a plurality of orienting blades coupled to said sand screen assembly, said orienting blades projecting radially with respect to the sand screen mandrels, and each having a radial projection which is less than the radius of a well casing in which a sand screen assembly is to be inserted, and which is greater than the radial projection of each annular roll collar relative to the external surface of the fluid-porous, particulate-restricting member.

7. An improved sand screen assembly for separating particulate material from formation fluid in deviated and horizontal wells comprising, in combination:

a mandrel having a tubular sidewall defining a flow passage for conveying formation fluid, said tubular sidewall having perforations for admitting formation fluid into the flow passage;

a fluid-porous particulate-restricting member mounted onto said mandrel in radially spaced relation with respect to said perforated sidewall;

an annular roll collar mounted on said mandrel in radially spaced, standoff relation with respect to said particulate-restricting member, said roll collar being adapted for slidable engagement against the side of a tubular well casing member for supporting said particulate-restricting member in radially spaced relation with respect to the inner bore surface of said well casing member; and, first and second tool-orienting blades coupled to said mandrel, said tool-orienting blades being longitudinally spaced with respect to each other and projecting radially with respect to said tubular mandrel, said tool-orienting blades being circumferentially offset with respect to each other, and the radial projection of each tool-orienting blade relative to said tubular mandrel being greater than the radial standoff of the annular roll collar relative to said tubular mandrel.

8. Well completion apparatus comprising, in combination:

well completion tool having a tubular mandrel and well completion apparatus mounted onto said mandrel;

first and second annular roll collars coupled to said mandrel: in radially spaced, standoff relation therewith, said annular roll collars being longitudinally spaced with respect to each other; and, first and second tool-orienting blades coupled to said mandrel, said tool-orienting blades projecting radially with respect to said mandrel, and said tool-orienting blades being longitudinally spaced and circumferentially offset with respect to each other.

9. Well completion apparatus as defined in claim 8, wherein said well completion tool is a sand screen having a fluidporous particulate-restricting member mounted on said mandrel.

10. Well completion apparatus as defined in claim 8, wherein said well completion tool is a lift gas sub having a radially projecting side pocket mandrel in which a lift gas valve is received.

11. Well completion apparatus as defined in claim 8, wherein said well completion tool is a perforating gun.

12. Well completion apparatus as defined in claim 8, wherein said well completion tool is a safety valve landing nipple having a tubular control conduit mounted on said mandrel.

13. Well completion apparatus a defined in claim 8, wherein said well completion tool is a well logging instrument having a radially projecting transducer mounted on said mandrel.

14. Well completion apparatus as defined in claim 8, wherein said well completion tool is a circulation sub having circulation ports and a tubular sleeve for opening and closing the circulation ports.

15. Well completion apparatus as defined in claim 8, wherein said well completion tool is a scoop head landing assembly having a threaded box coupling for releasably connecting a tubing string to production equipment, said scoop head landing assembly having a scoop pocket and a sloping lead-in surface for guiding the threaded end of the tubing string into threaded engagement with the threaded box coupling.

16. Well completion apparatus comprising, in combination:

a well completion tool having a tubular mandrel and well completion apparatus mounted on said completion tool mandrel;

a positioning tool including a mandrel having a tubular sidewall defining a flow passage for conveying formation fluid, said positioning tool mandrel being connected in series with said well completion tool mandrel;

orienting apparatus mounted on the well completion tool mandrel and the positioning tool mandrel, said orienting apparatus including:

first and second annular roll collars attached to at lest one of said mandrels in radially spaced, standoff relation therewith, said annular roll collars being longitudinally spaced with respect to each other; and, first and second tool-orienting blades attached to at least one of said mandrels, said tool-orienting blades projecting radially with respect to said mandrels, and said tool-orienting blades being longitudinally spaced and circumferentially offset with respect to each other.

17. Well completion apparatus comprising, in combination:

a well completion tool having a tubular mandrel and well completion apparatus mounted on said completion tool mandrel;

a positioning tool having a tubular mandrel and orienting apparatus mounted on said positioning tool mandrel, the positioning tool mandrel being mechanically coupled in series with the well completion tool mandrel;

said orienting apparatus including an annular roll collar mounted onto the positioning tool mandrel in radially spaced, standoff relation therewith, and a tool-orienting blade coupled to said mandrel, said tool-orienting blade projecting radially with respect to the positioning tool mandrel; and, wherein the annular roll collar has a radial standoff spacing relative to the tubular mandrel which is less than the inside radius of a well casing in which the orienting apparatus is to be inserted, and wherein said tool-orienting blade has a radial projection which is less than the radius of the well casing, and which is greater than the radial standoff spacing of the annular roll collar.

18. Well completion apparatus comprising, in combination:

a well completion tool having a tubular mandrel and well completion apparatus mounted on said completion tool mandrel;

a positioning tool having a tubular mandrel and orienting apparatus mounted on said positioning tool mandrel, the positioning tool mandrel being mechanically coupled in series with the well completion tool mandrel;

said orienting apparatus including an annular roll collar mounted onto the positioning tool mandrel in radially spaced, standoff relation therewith, and a tool-orienting blade coupled to said mandrel, said tool-orienting blade projecting radially with respect to the positioning tool mandrel; and, said annular roll collar having a radial standoff spacing relative to the positioning tool mandrel which is less than the inside radius of a well casing in which the well completion tool is to be inserted, and wherein the tool-orienting blade has a radial projection which is less than the inside diameter radius of the well casing member, and which is greater than the radial projection of the annular roll collar.

19. Well completion apparatus comprising, in combination:

a well completion tool having a tubular mandrel and well completion apparatus mounted on said completion tool mandrel;

a first positioning tool having a tubular mandrel and orienting apparatus mounted on the first positioning tool mandrel;

a second positioning tool having a tubular mandrel and orienting apparatus mounted on the second positioning tool mandrel;

the well completion tool mandrel being mechanically coupled intermediate the first and second positioning tool mandrels;

the orienting apparatus of the first and second positioning tools each including an annular roll collar mounted on the positioning tool mandrels, respectively, in radially spaced, standoff relation therewith, with the annular roll collars on the first and second positioning tools being longitudinally spaced with respect to each other; and, the orienting apparatus of the first and second positioning tools each having a tool-orienting blade mounted onto the positioning tool mandrels, respectively, each tool-orienting blade projecting radially with respect to the positioning tool mandrels, and the tool-orienting blades on the first and second positioning tool mandrels being longitudinally spaced and circumferentially offset with respect to each other.

* * * * *